US009689645B2

(12) United States Patent
Bouquet

(10) Patent No.: US 9,689,645 B2
(45) Date of Patent: Jun. 27, 2017

(54) INTERFACE FOR A SIGHTING DEVICE FOR A FIREARM

(71) Applicant: ETAT FRANCAIS REPRESENTE PAR LE DELEGUE GENERAL POUR L'ARMEMENT, Paris (FR)

(72) Inventor: Didier Bouquet, Courgent (FR)

(73) Assignee: ETAT FRANCAIS REPRESENTE PAR LE DELEGUE GENERAL POUR L'ARMEMENT, Paris (FR)

( * ) Notice: Subject to any disclaimer, the term of this patent is extended or adjusted under 35 U.S.C. 154(b) by 0 days.

(21) Appl. No.: 15/026,120

(22) PCT Filed: Sep. 30, 2013

(86) PCT No.: PCT/FR2013/000255
§ 371 (c)(1),
(2) Date: Mar. 30, 2016

(87) PCT Pub. No.: WO2015/044531
PCT Pub. Date: Apr. 2, 2015

(65) Prior Publication Data
US 2016/0223294 A1 Aug. 4, 2016

(51) Int. Cl.
*F41G 11/00* (2006.01)

(52) U.S. Cl.
CPC ..... *F41G 11/002* (2013.01); *F41G 11/003* (2013.01)

(58) Field of Classification Search
CPC ..... F41G 11/002
USPC ..... 42/124
See application file for complete search history.

(56) References Cited

U.S. PATENT DOCUMENTS

| | | | | |
|---|---|---|---|---|
| 2,774,143 | A | 12/1956 | Sunderland | |
| 3,882,609 | A | 5/1975 | Troutman | |
| 4,026,054 | A | 5/1977 | Snyder | |
| 7,448,306 | B2 * | 11/2008 | Shipman | F41F 1/06 89/37.05 |
| 8,161,674 | B2 * | 4/2012 | Holmberg | F41C 27/00 42/124 |

(Continued)

FOREIGN PATENT DOCUMENTS

| | | |
|---|---|---|
| CA | 2 791 013 A1 | 3/2013 |
| DE | 27 03 990 A1 | 8/1978 |

OTHER PUBLICATIONS

International Search Report, dated May 16, 2014, from corresponding PCT Application.

*Primary Examiner* — Reginald Tillman, Jr.
(74) *Attorney, Agent, or Firm* — Young & Thompson

(57) ABSTRACT

In the field of aiming devices for firearms, an interface includes a longitudinal median plane XX', and:
- a first portion able to be fixed on a weapon,
- a second portion movable with respect to the first portion,
- elements for damping the movement of the second portion with respect to the first portion,
- an upper portion including elements able to allow the fixing of a telescope or a camera, wherein: the damping elements include at least a first and a second damper, one of which is placed on one side of the longitudinal median plane and between the first portion and the second portion or the upper portion, and the other one is placed on the other side of the longitudinal median plane XX' and between the first portion and the second portion or the upper portion.

14 Claims, 3 Drawing Sheets

(56) References Cited

U.S. PATENT DOCUMENTS

| | | | | |
|---|---|---|---|---|
| 8,429,845 | B1 * | 4/2013 | Swan | F41G 11/003 42/124 |
| 9,021,728 | B1 * | 5/2015 | Kocmich, IV | F41A 23/04 248/562 |
| 2011/0047855 | A1 * | 3/2011 | Wong | F41G 11/002 42/124 |
| 2012/0240446 | A1 | 9/2012 | Lee et al. | |
| 2014/0059908 | A1 | 3/2014 | Dextraze et al. | |

* cited by examiner

INTERFACE FOR A SIGHTING DEVICE FOR A FIREARM

BACKGROUND OF THE INVENTION

Field of the Invention

The invention relates to the field of aiming devices for firearms.

Description of the Related Art

There are many commercially available aiming devices. These devices can, for example, be mounted on a handgun or on a rifle.

However, most of these devices cannot be used directly on a machine-gun. Indeed, the weapon recoil and the vibrations generated upon firing are such that, in most cases, the sight is damaged from the first burst of gunfire. Furthermore, some machine-guns are designed to be fixed on a marine, land or aerial vehicle generating additional vibrations and accelerations.

To partially solve these disadvantages is known U.S. Pat. No. 4,026,054 which describes an interface able to be fixed on a weapon and to be positioned between said weapon and a sight, said interface being able to damp the accelerations experienced by the sight upon firing and/or during moving of the vehicle on which the machine-gun is mounted.

Said interface comprises:

a first portion able to be fixed on a weapon, a second portion movable with respect to the first portion, spring-loaded means for damping the movement of the second portion with respect to the first portion, an upper portion comprising means able to allow the fixing of a telescope or a camera, means able to adjust the inclination of the upper portion with respect to the second portion.

Thus, upon firing, the weapon will move backwards with a significant acceleration while the spring-loaded damping means hold the sight, such that it experiences a lower acceleration with respect to that of the weapon.

Such a device is perfect for implementing an aiming device of a few tens of grams. However, it is not possible to use it for an aiming device with a weight of more than 500 grams. Indeed, in this case, it would be necessary to use springs of very large diameters, which would require the aiming device to be moved away from the weapon barrel, and thus a significant decrease of the short-distance accuracy.

BRIEF SUMMARY OF THE INVENTION

The invention aims to solve this disadvantage by providing an interface able to be fixed on a weapon and to be positioned between said weapon and an optical device, such as for example a sight, and able to damp the accelerations experienced by the optical device with respect to those experienced by the weapon, and this without any loss of short-distance accuracy even for an optical device whose mass is more than one kilogram.

The solution provided is an interface able to be fixed on a weapon and to be positioned between said weapon and an optical device, said interface comprising a longitudinal median plane XX' and:

a first portion able to be fixed on a weapon, a second portion movable with respect to the first portion, means for damping the movement of the second portion with respect to the first portion, an upper portion comprising means able to allow the fixing, directly or indirectly, of a telescope or a camera, said interface being characterized in that:

the damping means comprise at least a first and a second damper, one of which is placed on one side of the longitudinal median plane and between the first portion and the second portion or the upper portion, and the other one is placed on the other side of the longitudinal median plane XX' and between the first portion and the second portion or the upper portion.

According to a particular feature, the first damper is spring-loaded or pneumatic or hydraulic or with a power absorbing means, for example with an elastomer, and the second damper is spring-loaded or pneumatic or hydraulic or with a power absorbing means, for example with an elastomer.

According to a particular feature:

the first portion comprises at least a first wing on one of its lateral sides and at least a second wing on the other lateral side, the second portion comprises at least a third wing on one of its lateral sides and at least a fourth wing on the other lateral side, the first damper is longitudinally placed between said wings of the first and second portions arranged on a same first lateral side of the interface, and the second damper is longitudinally placed between said wings of the first and second portions arranged on the same second lateral side of the interface, and the first lateral side being arranged on one side of the longitudinal median plane XX' and the second lateral side being arranged on the other side of the longitudinal median plane XX'.

According to a feature allowing the mobility of the first portion with respect to the second one, the first portion comprises a rail arranged longitudinally, said rail being preferably a ball rail, and the second portion comprises, on its lower face, a first assembly forming a sliding piece and able to cooperate with said rail to form a slide.

According to a particular feature, the dampers are spring-loaded and:

the first portion comprises a wing at each one of its side ends, the second portion comprises a wing on each one of its lateral sides, preferably at their median portion, the spring-loaded damping means comprise:

- a first lateral spring longitudinally arranged between a first wing of the first portion and a first face of a first wing of the second portion,
- a second lateral spring longitudinally arranged between a second face of said first wing of the second portion and a second wing of the first portion,
- a third lateral spring longitudinally arranged between a third wing of the first portion and a first face of the second wing of the second portion,
- a fourth lateral spring longitudinally arranged between a second face of said first wing of the second portion and a second wing of the first portion, the first and second springs being coaxially arranged on one side of the interface, and the third and fourth springs being coaxially arranged on the other side of the interface.

According to another embodiment allowing to obtain the same results, the interface is characterized in that:

the second portion comprises a wing at each one of its side ends, the first portion comprises a wing on each one of its lateral sides, preferably at its median portion, the spring-loaded damping means comprise:

a first lateral spring longitudinally arranged between a first wing of the second portion and a first face of a first wing of the first portion, a second lateral spring longitudinally arranged between a second face of said first wing of the first portion and a second wing of the second portion, a third lateral spring longitudinally arranged between a third wing of the second portion and a first face of the second wing of the first portion, a fourth lateral spring longitudinally arranged between a second face of said first wing of the first portion and a second wing of the second portion, the first and second springs being coaxially arranged on one side of the interface, and the third and fourth springs being coaxially arranged on the other side of the interface.

According to a feature allowing to adjust the elevation, an interface according to the invention comprises means for adjusting the inclination of the upper portion with respect to the second portion.

According to another feature:

the first portion comprises a base and a first plate, the second portion comprises a second plate, the upper portion comprises a third plate, one of the longitudinal ends of which is connected to one of the longitudinal ends of the second plate by a hinge-type link.

According to an additional feature, said adjusting means comprise, on the one hand, a hinge-type link between a first longitudinal end of the second plate and a first longitudinal end of the third plate and, on the other hand, means for adjusting the spacing between said first and second plates at their respective second longitudinal ends.

According to a particular feature, the means for adjusting the spacing between said second and third plates comprise a wheel with successive notches arranged in a spiral.

BRIEF DESCRIPTION OF THE DRAWINGS

Other advantages and features of the invention will become more apparent upon reading the description of several embodiments of the invention, and with reference to the appended drawings, in which.

DETAILED DESCRIPTION OF THE PREFERRED EMBODIMENTS

Figure 1:
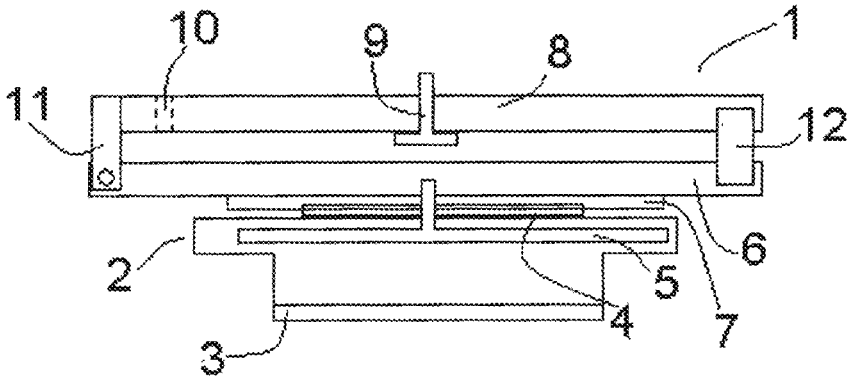
FIG. 1 shows a diagram of a side view of an interface according to an embodiment of the invention, said interface being able to be fixed on a weapon and to be positioned between said weapon and an optical device.

FIG. 1 shows a diagram of a side view of an interface according to one embodiment of the invention, said interface being able to be fixed on a weapon and to be positioned between said weapon and an optical device.

Said interface comprises:

a first portion 2, 3, 4 able to fixed on a weapon, a second portion 6, 7 movable with respect to the first portion, means 5 for damping the movement of the second portion with respect to the first portion, a third portion 8 called the upper portion and comprising means 9, 10 able to allow the fixing of a telescope or a camera while allowing to adjust the elevation.

The first portion comprises, on the one hand, means 3 for fixing the interface 1 to a weapon and, on the other hand, a rail 4 arranged longitudinally, said rail being preferably a ball rail. The second portion comprises a first assembly 7 forming a sliding piece and able to cooperate with said rail 4 to form a slide.

The interface further comprises means 11, 12 for adjusting the inclination of the upper portion with respect to the second portion.

Figure 2:
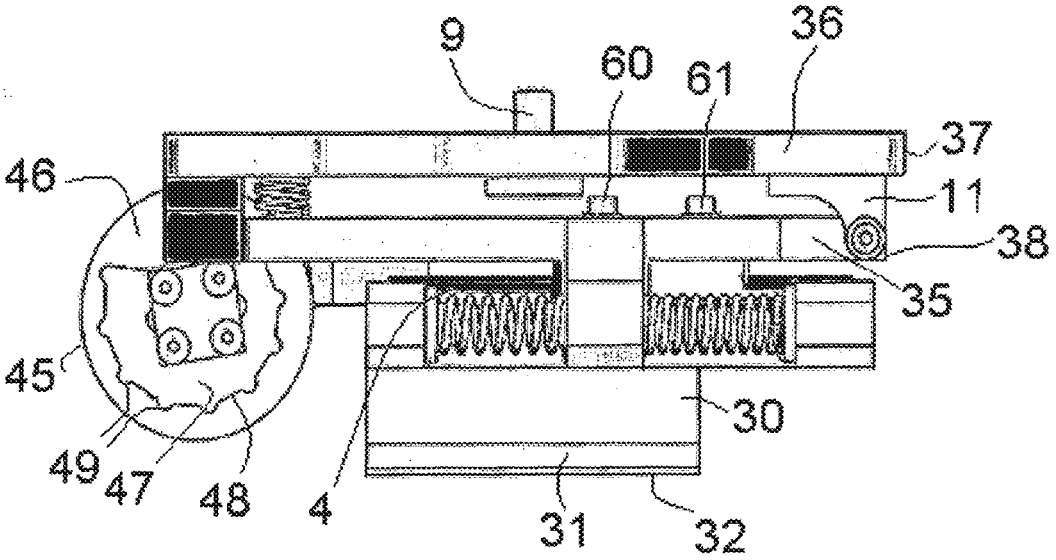
FIG. 2 shows a diagram of a side view of an interface according to an embodiment similar to that of FIG. 1.
Figure 3:
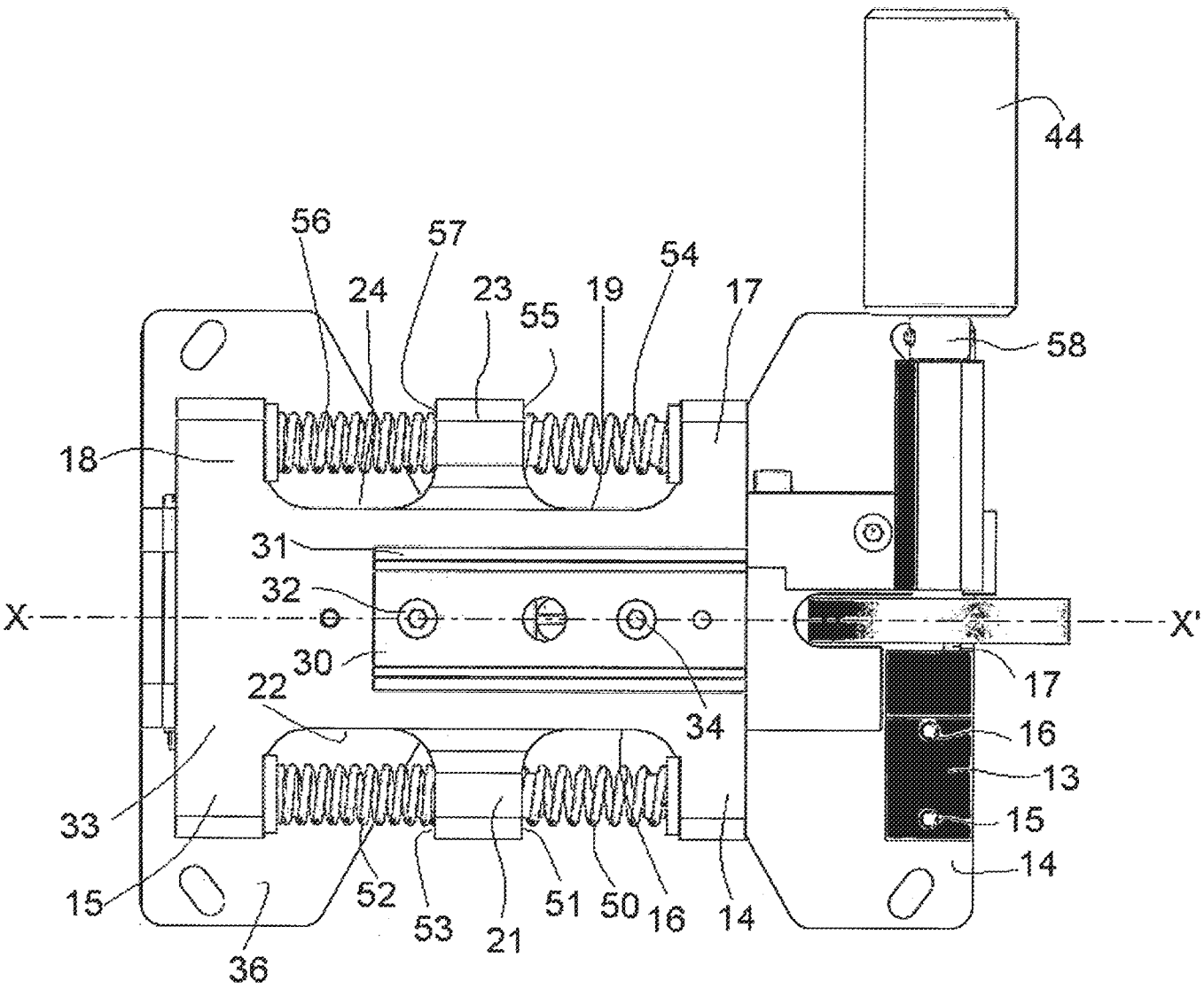
FIG. 3 shows a diagram of a bottom view of the interface according to FIG. 2.

FIGS. 2 and 3 show a diagram of a side view and a bottom view of an interface similar to that of FIG. 1. This interface comprises a longitudinal median plane XX': when the interface is fixed on a weapon, the longitudinal median plane XX' passes through the axis of the weapon barrel or, when the weapon has two barrels, between the axes of the barrels.

The first portion comprises:

a base 30 with a dovetailed tenon 31 at its lower face 32 able to cooperate with a mortise longitudinally fixed on the barrel of a weapon, a first plate 33 fixed to the base 30 by screws 34 and on which a rail 4 is fixed.

This first plate comprises a first and a second wing 14, 15 on a first lateral side 16 and a third and a fourth wing 17, 18 on its second lateral side 19.

The second portion comprises a second plate 35 having:

a first wing 21 on a first lateral side 22 and a second wing 23 on its second lateral side 24, a first assembly 7, forming a sliding piece and able to cooperate with said rail 4 to form a slide, is fixed to the second plate 35 by two screws 60, 61.

The third portion comprises a third plate 36, one of the longitudinal ends of which is connected to a longitudinal end 38 of the longitudinal ends of the second plate 35 by a hinge-type link 11.

The interface further comprises means 12 for adjusting the inclination of the third plate 36 with respect to the second plate 35, in cooperation with the link 11.

The spring-loaded damping means comprise:

a first lateral spring 50 longitudinally arranged between the first wing 14 of the first plate 33 and a first face 51 of the first wing 21 of the second plate 35, a second lateral spring 52 longitudinally arranged between a second face 53 of said first wing of the second plate 35 and the second wing 15 of the first plate 33, a third lateral spring 54 longitudinally arranged between the third wing 17 of the first plate 33 and a first face 55 of the second wing 23 of the second plate 35, a fourth lateral spring 56 longitudinally arranged between a second face 57 of said first wing of the second plate 35 and the fourth wing 18 of the first plate 33, the first and second springs 50, 52 being coaxially arranged on one side of the interface, and the third and fourth springs 54, 56 being coaxially arranged on the other side of the interface.

Thus, each one of the springs is entirely placed on one side or the other of the longitudinal median plane XX'. These springs can be changed according to the weight of the optics and of the ammunition used, in order to ensure optimum damping.

Figure 4:
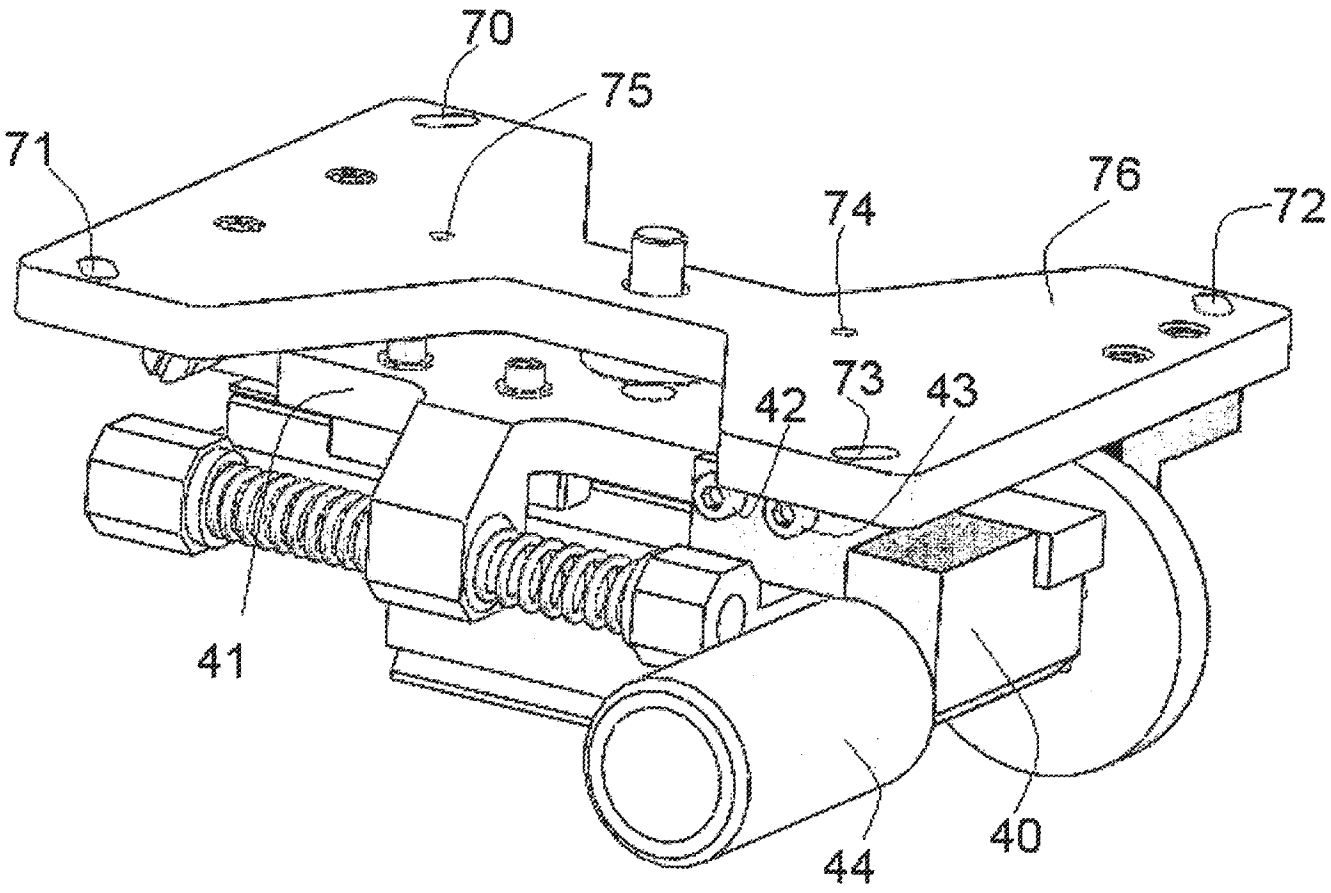
FIG. 4 shows a diagram of a perspective view of the interface according to FIG. 2.

As shown in FIG. 4, the means 12 for adjusting the inclination of the third plate 36 with respect to the second plate 35 comprise:

a substantially L-shaped first block 40, the longest arm of which is fixed to a lateral face 41 of the second plate 35 by two screws 42, 43, and such that the base of L is perpendicular to the axis of said lateral face 41, an adjustment knob 44 connected to a wheel 45 by a shaft which is held in position within a through bore provided in said block 40, and such that this shaft is perpendicular to said longitudinal median plane XX'. The wheel 45 comprises, on its face 46 opposed to that facing the knob 44, an impression 47, the periphery of which is in the shape of a spiral 48 comprising semicircular recesses 49 regularly spaced along this spiral, an L-shaped second block 13, the longest arm of which is fixed to a lower face 14 of the third plate 36 by two screws 15, 16, and such that the base of L is perpendicular to said lower face 14. Furthermore, the outer face of the base of L comprises a rod 17 perpendicularly fixed to this face and with a diameter substantially equal to, but slightly less than, that of said semicircular recesses 49, the latter forming successive notches for said rod, a spring arranged between said second and third plates and held in place by a first and a second teat facing each other, integral with the second and the third plates, respectively.

Furthermore, the third plate 36 comprises oblong bores 70, 71, 72 and 73 provided in the thickness direction and a bolt 9 allowing, for example, the fixing of a Sophie-type camera and the azimuth adjusting of the latter.

Two additional bores 74, 75 arranged in the median portion of the third plate 36 and provided in the thickness direction allow, for example, the fixing of a PICATINI rail on which many different aiming devices can be installed.

The implementation of the interface for the installation of a Sophie-type camera on a machine-gun 12,7 could be as follows:

A camera is fixed on the upper face 76 of the third plate using the bolt 9 and four other bolts designed to be inserted in the oblong bores, and then in tapped bores of the camera.

The assembly formed by the interface and the camera is then fixed on the barrel of the machine-gun 12,7 via the slide formed by the tenon 3 and a dovetailed mortise 3 integral with the barrel.

The knob 44 is then optionally rotated to adjust the elevation according to the expected firing distance. The wheel 45 associated with this knob 44 is interchangeable, and the shape of the impression 47 and the positioning of the semicircular recesses 49 are a function of the ammunition used.

Optionally, test firing is performed to adjust, in azimuth, the positioning of the camera with respect to the interface.

Upon firing, in bursts or not, the recoil of the machine-gun 12,7 occurs with a very high acceleration. The interface according to the invention allows, thanks to its specific damping means, to damp this acceleration such that the camera experiences only a very low acceleration compatible with its operation and the preservation of its physical integrity.

Many modifications can be made to the examples described above without departing from the scope of the invention. Thus, the damping means can comprise, in place of the springs, pneumatic or even hydraulic means or even a power absorbing means, for example with felt.

Furthermore, in the case where firing is always performed at the same distance, the second portion can be equated with the third portion.

The invention claimed is:

1. An interface configured to be fixed on a weapon and to be positioned between said weapon and an optical device, said interface comprising:

a longitudinal median plane;

a first portion able to be fixed on a weapon;

a second portion movable with respect to the first portion;

an upper portion comprising a fixing device configured to fix a telescope or a camera;

a damper system configured to damp movement of the second portion with respect to the first portion, the damper system comprising at least a first damper and a second damper, one of the first damper and the second damper being placed on one side of the longitudinal median plane and between the first portion and the second portion or the upper portion, and the other of the first damper and the second damper being placed on the other side of the longitudinal median plane and between the first portion and the second portion or the upper portion; and an adjustment system configured to adjust the inclination of the upper portion with respect to the second portion, wherein the first and second portions are made integral by a rail longitudinally arranged between the first and second dampers and independent from the damper system.

2. The interface according to claim 1, wherein the rail is a ball rail.

3. The interface according to claim 1, wherein the first portion comprises a base and a first plate and the rail arranged longitudinally and the second portion comprises a first assembly forming a sliding piece and being configured to cooperate with said rail to form a slide.

4. The interface according to claim 1, wherein the second portion comprises a second plate and the upper portion comprises a third plate, one of the longitudinal ends of the third plate being connected to one of the longitudinal ends of the second plate by a hinge link.

5. The interface according to claim 4, wherein said adjustment system comprises the hinge link between a first longitudinal end of the second plate and a first longitudinal end of the third plate, and an adjusting device configured to adjust the spacing between said second and third plates at their respective second longitudinal ends.

6. The interface according to claim 4, wherein the adjusting device comprises a wheel with successive notches arranged in a spiral.

7. The interface according to claim 1, wherein the first damper is spring-loaded, and the second damper is spring-loaded.

8. The interface according to claim 1, wherein the first damper is pneumatic and the second damper is pneumatic.

9. The interface according to claim 1, wherein the first damper is hydraulic and the second damper is hydraulic.

10. The interface according to claim 1, wherein the first damper is a power absorbing device and the second damper is a power absorbing device.

11. The interface according to claim 10, wherein the first damper is an elastomeric power absorbing device and the second damper is an elastomeric power absorbing device.

12. The interface according to claim 1, wherein the first portion comprises at least a first wing on one of its lateral sides and at least a second wing on the other of its lateral sides, the second portion comprises at least a third wing on one of its lateral sides and at least a fourth wing on the other of its lateral sides, the first damper is longitudinally disposed between said wings of the first and second portions arranged on a same first lateral side of the interface, and the second damper is longitudinally disposed between said wings of the first and second portions arranged on the same second lateral side of the interface, the first lateral side being disposed on one side of the longitudinal median plane and the second lateral side being disposed on the other side of the longitudinal median plane.

13. The interface according to claim 1, wherein the dampers are spring-loaded, the first portion comprises a wing at each one of its side ends, the second portion comprises a wing on each one of its lateral sides, and the spring-loaded damping system comprises a first lateral spring longitudinally disposed between a first wing of the first portion and a first face of a first wing of the second portion, a second lateral spring longitudinally disposed between a second face of said first wing of the second portion and a second wing of the first portion, a third lateral spring longitudinally disposed between a third wing of the first portion and a first face of the second wing of the second portion, a fourth lateral spring longitudinally disposed between a second face of said second wing of the second portion and a second wing of the first portion, the first and second springs being coaxially disposed on one side of the interface, and the third and fourth springs being coaxially disposed on the other side of the interface.

14. The interface according to claim 1, wherein the dampers are spring-loaded, the second portion comprises a wing at each one of its side ends, the first portion comprises a wing on each one of its lateral sides, and the spring-loaded damping system comprises a first lateral spring longitudinally disposed between a first wing of the second portion and a first face of a first wing of the first portion, a second lateral spring longitudinally disposed between a second face of said first wing of the first portion and a second wing of the second portion, a third lateral spring longitudinally disposed between a third wing of the second portion and a first face of the second wing of the first portion, a fourth lateral spring longitudinally disposed between a second face of said first wing of the first portion and a second wing of the second portion, the first and second springs being coaxially disposed on one side of the interface, and the third and fourth springs being coaxially disposed on the other side of the interface.

* * * * *